US005823805A

United States Patent [19]

Weihing et al.

[11] Patent Number: 5,823,805

[45] **Date of Patent: *Oct. 20, 1998**

[54] ELECTRICAL CONNECTOR FOR A LIGHT SOURCE

[76] Inventors: Gerhard Weihing, Albert-Schweitzer-Str. 13, 72810 Gomaringen; Georg Ebinger, Jahnstr. 35, 72127 Kusterdingen; Andreas Gauder, Mühlbachstr. 2, 70794 Filderstadt, all of Germany

[ * ] Notice: The terminal 14 months of this patent has been disclaimed.

[21] Appl. No.: 454,109

[22] PCT Filed: Sep. 28, 1994

[86] PCT No.: PCT/DE94/01143

§ 371 Date: May 26, 1995

§ 102(e) Date: May 26, 1995

[87] PCT Pub. No.: WO95/10730

PCT Pub. Date: Apr. 20, 1995

[30] Foreign Application Priority Data

Oct. 12, 1993 [DE] Germany ..... 43 34 722.3

[51] Int. Cl.[6] ..... H01R 13/648

[52] U.S. Cl. ..... 439/108; 439/611

[58] Field of Search ..... 439/101, 108, 439/607, 609, 611, 617, 618

[56] References Cited

U.S. PATENT DOCUMENTS 4,198,027 4/1980 Urbanek ..... 439/108

5,112,251 5/1992 Cesar ..... 439/108

FOREIGN PATENT DOCUMENTS 0215700 3/1987 European Pat. Off. .

3831371 3/1990 Germany .

*Primary Examiner*—Hien Vu

*Attorney, Agent, or Firm*—Michael J. Striker

[57] ABSTRACT

The electrical connector is used for connection to a light source having a contact element (20) for electrical connection with a positive terminal of a voltage source and a base plate (18) and/or base section (22) for a ground connection. The electrical connector includes a plug part (30) having a contacting receptacle (32) formed to fit together with the contact element (20) of the light source, an electrically insulating sheath (36, 38, 40) and a ground contact element (50) arranged on the sheath (38). The electrically insulating sheath is provided with an opening (44) for insertion of the contact element (20) so that the contacting receptacle (32) is contacted by the contact element (20). The ground contact element (50) has a sleeve-like section (52) arranged on the sheath (38), and advantageously two contact arms (54) extending from the sleeve-like section (52) toward the light source (14) and bent toward the contact element (20) to bear under tension against the base plate (18) or base section (22) when the contact element (20) is inserted into the plug part (30).

9 Claims, 3 Drawing Sheets

ELECTRICAL CONNECTOR FOR A LIGHT SOURCE

BACKGROUND OF THE INVENTION

The present invention relates to an electrical connector for a light source, especially for a light source in a headlight of a vehicle.

A known electrical connector of this type is disclosed by DE 38 31 371A1. There, the light source is an incandescent lamp of the type H1, fitted into a reflector of a headlamp for vehicles. This light source has a contact pin, which serves for the electrical connection of the light source to the positive terminal of a voltage source. In addition, the light source has a base, via which the ground connection of the light source takes place. For connecting the light source to the positive terminal of the voltage source, a plug part is pushed on to its contact pin. Acting on the base of the light source is a metallic retaining clip, by which the light source is retained on the reflector and this retaining clip has a plug contact, on to which there can be pushed a further plug part, which establishes a ground connection of the light source. Consequently, for the electrical contacting of the light source, here two separate plug parts have to be fitted, which means that considerable work is involved.

ADVANTAGES OF THE INVENTION

It is an object of the present invention to provide an electrical connector for a light source, especially for a light source used in the headlight or other lighting device of a vehicle, which avoids the above-described disadvantages.

This object and others which will become more apparent hereinafter are attained in an electrical connector for a light source, the light source having a contact element for connection with a positive terminal of a voltage source and a base for a ground connection, the electrical connector comprising a plug part having a contacting receptacle formed to fit together with the contact element, advantageously a contact pin, of the light source.

According to the invention, the plug part has an electrically insulating sheath provided with an opening for insertion of the contact element so that the contacting receptacle is contacted by the contact element, and a ground contact element arranged on the sheath. This ground contact element has a sleeve-like section arranged on the sheath, and at least one resilient contact arm extending from the sleeve-like section toward the light source and bearing under tension against the base transversely to the fitting direction of the plug part on the contact element when the contact element is plugged into the plug part.

The electrical connector for a light source according to the invention, has in comparison the advantage that only one plug part by which the connection of the light source to the positive terminal of the voltage source and the ground connection are established at the same time needs to be connected to the light source.

The electrical connector according to the invention is particularly compact because the ground contact element only slightly increases the overall size of the plug part.

Several embodiments with advantageous additional features are possible. The end region of the at least one contact arm coming to bear against the base of the light source preferably is U-shaped and curved so as to have a vertex pointing toward the base. Advantageously the sleeve-like section of the ground contact element has two of the contact arms diametrically opposed to each other and with vertices pointing toward each other. Because of these features short circuits created by the contact element or pin of the light source on insertion of it into the plug part are avoided.

BRIEF DESCRIPTION OF THE DRAWING

The objects, features and advantages of the invention will now be illustrated in more detail with the aid of the following description of the exemplary embodiment, with reference to the accompanying figures in which.

DESCRIPTION OF THE EXEMPLARY EMBODIMENT

Figure 1:
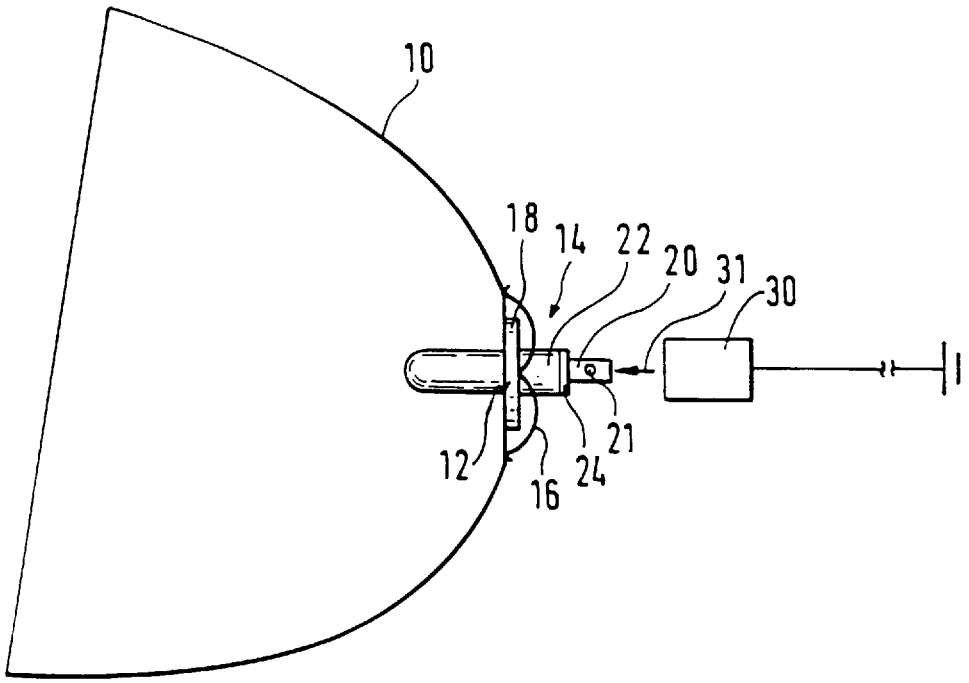
FIG. 1 is a partially cross-sectional, partially side, view of a light source and an electrical connector according to the invention.
Figure 3:
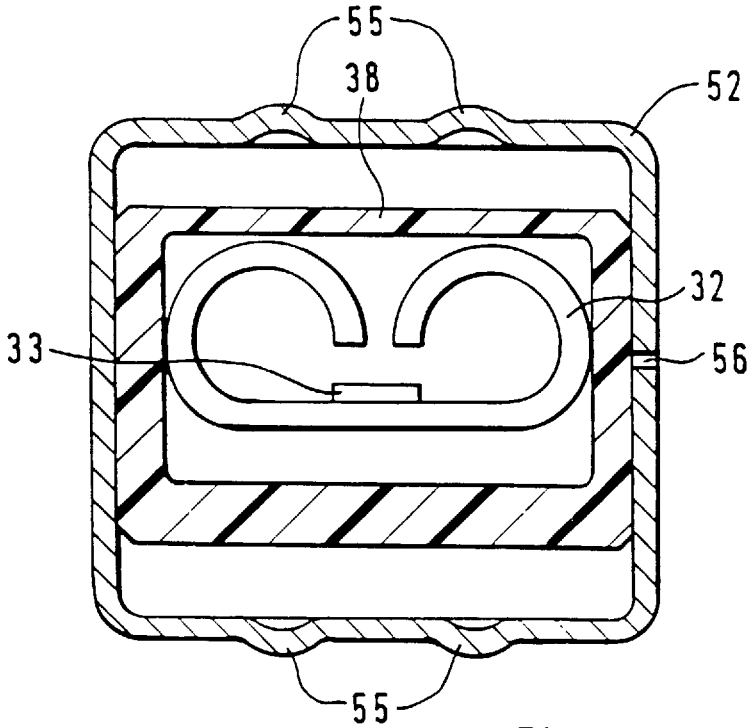
FIG. 3 is a transverse cross-sectional view taken through the electrical connector of FIGS. 1 and 2 along the section line III—III in FIG. 2 showing the contact element only partially inserted in the electrical connector.

In FIG. 1 a lighting means for a vehicle which is a headlight, but may also be a luminaire or the like, is shown. The headlight has a reflector 10, with an opening 12, into which a light source 14 is fitted. In the case of the exemplary embodiment, the light source 14 is an incandescent lamp, in particular of the H1 type, and has a coiled filament as the luminous element. The light source 14 is retained on the reflector 10, for example by means of a spring clip 16, which acts on the base plate 18 of the light source 14. The light source 14 has a contact pin 20 acting as the contact element on the face end of its base facing away from the reflector 10 which serves for the connection to the positive terminal of a voltage source. The contact pin 20 is provided with a bore 21 or a depression. The ground connection of the light source 14 takes place via its metallic base plate 18 or a metallic, approximately cuboidal or cylindrical base section 22 adjoining this plate. Between the metallic base section 22 and the contact pin 20 there is a section 24 of electrically insulating material, the diameter of which is somewhat smaller than that of the base section 22.

Figure 2:
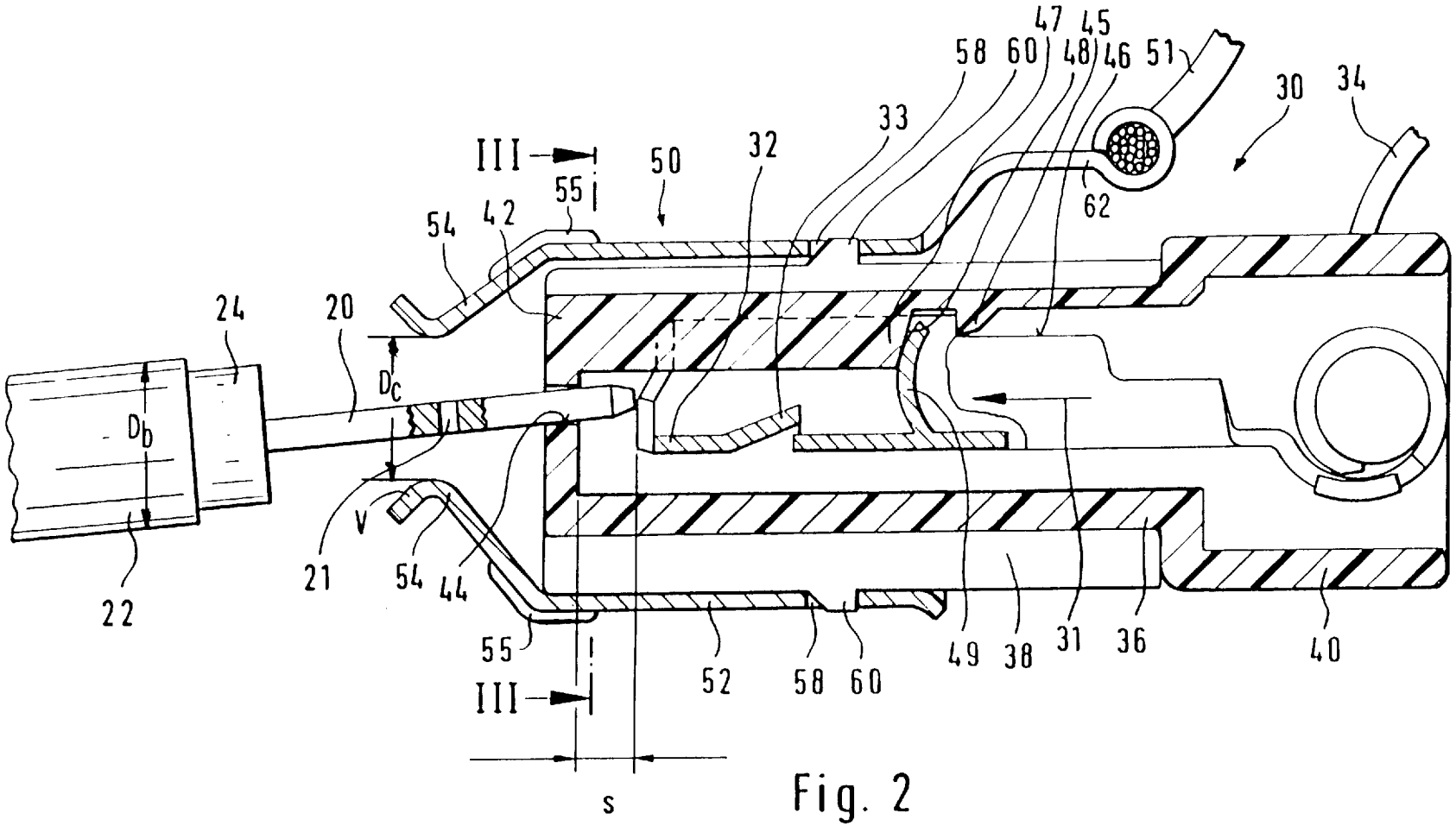
FIG. 2 is a detailed cross-sectional view through the electrical connector according to the invention shown in FIG. 1 at the start of connection of the light source to the electrical connector.

The electrical connector of the light source 14 comprises a plug part 30, which can be pushed on to the contact pin 20 of the light source 14 in the direction of the arrow 31. The plug part 30 is shown in detail in FIG. 2. The plug part 30 has a contacting receptacle 32, in this embodiment a contacting sleeve, which is connected via an electrical line 34 to the positive terminal of a voltage source, in the case of the exemplary embodiment of the on-board battery of the vehicle, via a light switch. The receptacle 32 has a resilient projection 33, which protrudes inward from it and inter-acts with the bore 21 in the contact pin 20. The plug part 30 has an electrically insulating sheath 36, which has a section 38 surrounding the receptacle 32 and has a section 40 surrounding the connection piece of the electrical line 34. The line 34 may extend out of the plug part 30 approximately coaxially to the fitting direction 31 of the plug part 30 or transversely thereto. The section 38 of the sheath 36 surrounding the receptacle 32 has a rectangular cross-section transverse to the fitting direction 31 of the plug part 30 and has on its front face end, facing toward the light source 14, a wall 42, in which there is an opening 44 for the insertion of the contact pin 20 of the light source 14. The cross section of the opening 44 is in this case adapted to that of the contact pin 20 such that the contact pin 20 passes through the opening 44 with little clearance transversely to the fitting direction 31 of the plug part 30. With a simple configuration of the plug part 30, the receptacle 32 is fixed within the sheath 38 in a way not shown. The plug part 30 may, however, also be designed to achieve a so-called positive-lock function. In this case, the end of the receptacle 32 facing toward the light source 14 is arranged at a distance from the wall 42 of the sheath 38. Protruding from the inner side of the sheath 38 toward the receptacle 32 is a lug 45, which engages in a recess 46 in the receptacle 32. Also protruding from the sheath 38 toward the receptacle 32 is a projection 47, which is provided with a ramp 48, facing counter to the fitting direction 31. Protruding from the receptacle 32 transversely to the fitting direction 31 is an arm 49, which can be swiveled elastically and comes to bear against the ramp 48.

During connection of the plug part 30, its sheath 36 is acted upon and the plug part 30 is pushed in the direction of the arrow 31 onto the light source, the receptacle 32 being supported on the lug 45 by the rim of its recess 46 neighbouring the light source 14, so that the receptacle 32 cannot move axially with respect to the sheath 36 and the contact pin 20 enters into the latter. In the end position of the plug part 30, which is determined by the bearing of the face end of the insulating section 24 of the base of the light source 14 against the wall 42 of the sheath 36, the projection 33 of the receptacle 32 catches in the bore 21 in the contact pin 20. In the removal of the plug part 30, its sheath 36 is acted upon and the latter is drawn counter to the arrow direction 31 from the light source 14. In this case, the arm 49 slides over the ramp 48 on the projection 47, the part of the receptacle 32 with the projection 33 thereby being swiveled, so that the projection 33 is lifted out of the bore 21 in the contact pin 20. When the wall 42 comes to bear against the face end of the receptacle 32 after the distance s, the plug part 30 can be taken off the light source 14 with little exertional force upon further movement counter to fitting direction 31.

Arranged on the section 38 of the sheath 36 surrounding the receptacle 32 is a metallic ground contact element 50, which is connected via a line 51 to ground. The ground contact element 50 comprises a sleeve-like section 52, which is retained on the section 38, and two resilient contact arms 54, protruding from said section toward the light source 14 in fitting direction 31 of the plug part 30. The sleeve-like section 52 is pushed on to the section 38 counter to the arrow direction 31 and, like the latter section, has a rectangular cross-section transverse to the fitting direction 31. The sleeve-like section 52 has a slit 56, so that it can be elastically expanded transversely to the fitting direction 31. In addition, on two mutually opposite side walls of the sleeve-like section 52 there is in each case an opening 58. From two mutually opposite outer sides of the section 38 of the sheath 36 there protrudes outward in each case a projection 60, which is bevelled toward the light source 14. Also protruding from the sleeve-like section 52, facing away from the light source 14, is a contact tab 62, to which the line 51 is connected. The ends of the sleeve-like section 52 facing away from the light source 14 are bent over outward, in order to permit easy pushing-on onto the section 38 of the sheath 36.

The contact arms 54 are bent toward each other in their region protruding beyond the section 38 of the sheath 36 and their ends are bent in a U-shaped manner, the vertices V of the U-shaped ends of the two contact arms 54 facing each other. The contact arms 54 are provided with a bead 55 in their resilient region, in order to increase their flexural rigidity. The distance $D_c$ between the ends of the contact arms 54 with respect to each other is somewhat smaller than the diameter $D_b$ of the cylindrical base section 22 of the light source 14.

For the fitting of the ground contact element 50, its sleeve-like section 52 is pushed on to the section 38 of the sheath counter to arrow direction 31. The width of the section 38 of the sheath 36 in the region of the two sides facing the projections 60 is somewhat greater than the cross section-of the sleeve-like section 52, so that the latter is expanded somewhat, which is made possible by its slit 56. In the end position of the ground contact element 50, the projections 60 pass through the opening 58 in the sleeve-like section 52, as a result of which a catch-like fastening of the contact element 50 on the section 38 is achieved.

Figure 4:
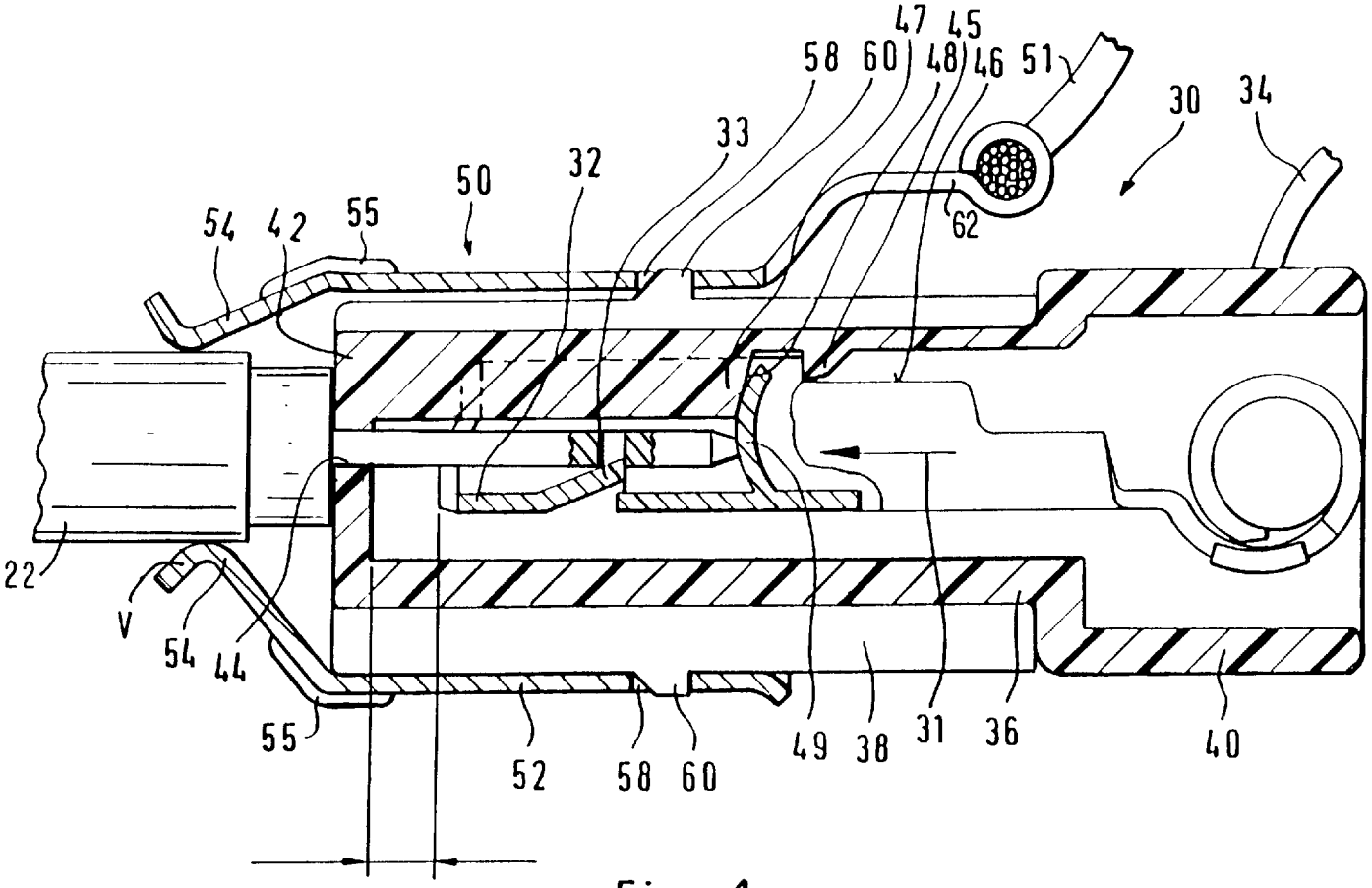
FIG. 4 is another detailed cross-sectional view through the electrical connector similar to FIG. 2 with the contact element of the light source inserted fully into the electrical connector and showing the contact arms contacting the light source base.

In the fitting of the plug part 30 on to the light source 14, the contact arms 54 of the ground contact element 50 are bent apart when they meet with their ends the insulating section 24 of the base of the light source 14. In the end position of the plug part 30, the contact arms 54 bear with their ends radially against the cylindrical base section 22 of the light source 14 under tension as shown in FIG. 4, so that the connection on the positive side and the ground connection of the light source 14 are established at the same time by the plug part 30.

The distance between the ends of the contact arms 54 and the end of the receptacle 32 facing the light source 14 and the cross section of the opening 44 through which the contact pin 20 passes are in this case matched to each other such that the contact pin 20 cannot come to bear as the result of an oblique positioning simultaneously against the ends of the contact arms 54 and against the receptacle 32, which would result in a short circuit. In this case, the distance between the end of the receptacle 32 facing the light source 14 and the wall 42 must also be taken into consideration. An oblique positioning of the contact pin 20 in a plane containing the two contact arms 54 is restricted by the fact that the contact pin passes through the opening 44 only with slight clearance. The smaller the distance of the ends of the contact arms 54 from the wall 42 of the sheath 36, the more the contact pin 20 can be obliquely positioned without at the same time coming to bear against the receptacle 32 and the ends of the contact arms 54. Conversely, the oblique positioning of the contact pin 20 must be restricted all the more closely the greater the distance of the ends of the contact arms 54 from the wall 42 of the sheath.

As a departure from the configuration described above, the contact arms 54 of the ground contact element 50 may also be designed such that they can come to bear against the base plate 18 of the light source 14. In addition, there may also be provided only one contact arm 54 or more than two contact arms 54. Finally, the light source 14 may also have a different contact element than the contact pin 20, for example a receptacle, the plug part 30 then having a plug-in element designed for interacting with the contact element.

The electrical contacting of a light source described above is not restricted to the application in the case of an H1 incandescent lamp but can be applied generally in the case of light sources with which a connection contact is provided only for the connection on the positive side, and the ground connection takes place via the base of the light source.

We claim:

1. An electrical connector for a light source, the light source (14) having a contact element (20) for connection with a positive terminal of a voltage source the light source having a metallic base plate (18) and a cylindrical base section (22) for a ground connection, said electrical connector comprising a plug part (30) having a contacting receptacle (32) formed to fit together with and to contact the contact element (20) of the light source, an electrically insulating sheath (36, 38, 40), said electrically insulating sheath being provided with an opening (44) for insertion of the contact element (20) in said sheath so that the contacting receptacle is contacted by the contact element (20), and a ground contact element (50) arranged on the sheath (38), wherein said ground contact element (50) has a sleeve-like section (52) arranged around the sheath (38) and at least one resilient contact arm (54), said at least one resilient contact arm (54) extends from said sleeve-like section (52) toward the light source (14), said at least one resilient contact arm (54) bears against the base plate (18) or base section (22) under tension and said at least one resilient contact arm (54) having an end portion bent toward the contact element (20) in a direction transverse to an engagement direction (31) of the plug part (30) so as to bear on the base plate (18) or base section (22) when the contact element (20) is plugged into the plug part (30).

2. The electrical connector as defined in claim 1, wherein the opening (44) is of a size such that the contact element (20) passes through said opening with a clearance small enough so that, during an oblique insertion of the contact element (20) in the electrically insulating sheath (36,38,40), the contact element (20) does not contact both the receptacle (32) and the at least one contact arm (54) at the same time.

3. The electrical connector as defined in claim 1, wherein the end portion of the at least one contact arm (54) comes to bear against the cylindrical base section (22) of the light source (14) and has a vertex (V) pointing toward said base section (22).

4. The electrical connector as defined in claim 1, wherein the sleeve-like section (52) can be pushed onto the electrically insulating sheath (38) and is elastically deformable transversely to said engagement direction.

5. The electrical connector as defined in claim 1, further comprising catch means (58,60) for retaining the ground contact element (50) on the insulating sheath (38).

6. The electrical connector as defined in claim 1, wherein the at least one contact arm (54) has a resilient region and means for stiffening said resilient region.

7. The electrical connector as defined in claim 6, wherein said means for stiffening comprises a bead in the resilient region of said at least one contact arm (54).

8. The electrical connector as defined in claim 1, wherein the light source (14) is an incandescent lamp for a headlight of a vehicle.

9. The electrical connector as defined in claim 1, wherein the contacting receptacle (32) is positioned inside the electrically insulating sheath.

* * * * *